US007748437B2

(12) United States Patent
Rohellec

(10) Patent No.: US 7,748,437 B2
(45) Date of Patent: Jul. 6, 2010

(54) HEAT EXCHANGER WITH TUBE CORE, IN PARTICULAR FOR A SUPERCHARGED INTERNAL COMBUSTION ENGINE

(75) Inventor: Jean-Yves Rohellec, Antony (FR)

(73) Assignee: Renault S.A.S., Boulogne Billancourt (FR)

( * ) Notice: Subject to any disclaimer, the term of this patent is extended or adjusted under 35 U.S.C. 154(b) by 361 days.

(21) Appl. No.: 11/573,074

(22) PCT Filed: Jul. 13, 2005

(86) PCT No.: PCT/FR2005/050580

§ 371 (c)(1),
(2), (4) Date: Feb. 1, 2007

(87) PCT Pub. No.: WO2006/021704

PCT Pub. Date: Mar. 2, 2006

(65) Prior Publication Data

US 2007/0209783 A1 Sep. 13, 2007

(30) Foreign Application Priority Data

Aug. 2, 2004 (FR) ..... 04 08507

(51) Int. Cl.
*F28F 9/26* (2006.01)

(52) U.S. Cl. ..... 165/144; 165/109.1

(58) Field of Classification Search ..... 165/144, 165/145, 109.1
See application file for complete search history.

(56) References Cited

U.S. PATENT DOCUMENTS

| | | | | |
|---|---|---|---|---|
| 1,510,807 | A * | 10/1924 | Soule | 165/180 |
| 2,162,148 | A * | 6/1939 | Wilson et al. | 303/1 |
| 4,287,945 | A | 9/1981 | Hessari | |
| 4,702,079 | A | 10/1987 | Saito et al. | |
| 5,303,770 | A | 4/1994 | Dierbeck | |
| 6,234,243 | B1 * | 5/2001 | Murching et al. | 165/133 |
| 6,341,648 | B1 * | 1/2002 | Fukuoka et al. | 165/144 |
| 6,527,046 | B1 * | 3/2003 | White | 165/297 |
| 7,073,571 | B2 * | 7/2006 | Yu et al. | 165/140 |
| 2003/0041857 | A1 * | 3/2003 | Marko | 126/680 |

FOREIGN PATENT DOCUMENTS

| | | | |
|---|---|---|---|
| DE | 4313567 | C1 * | 9/1994 |
| GB | 844 660 | | 8/1960 |
| WO | WO 9967592 | A1 * | 12/1999 |

* cited by examiner

*Primary Examiner*—Allen J Flanigan
(74) *Attorney, Agent, or Firm*—Oblon, Spivak, McClelland, Maier & Neustadt, L.L.P.

(57) ABSTRACT

A heat exchanger including at least a first manifold and a second manifold connected by a bundle of horizontal tubes. An air flow circulates to be cooled by a cooling air flow. The bundle includes at least: a first portion including a first series of tubes with turbulators of passage section corresponding to the section; a second portion including a first series of tubes with no turbulators of passage section and a second series of tubes with turbulators of passage section corresponding to the section; and a distribution box of internal air flow to be cooled including a connection mechanism between the first portion and the second portion.

17 Claims, 2 Drawing Sheets

HEAT EXCHANGER WITH TUBE CORE, IN PARTICULAR FOR A SUPERCHARGED INTERNAL COMBUSTION ENGINE

BACKGROUND OF THE INVENTION

I. Field of the Invention

The invention relates to a tube-bundle heat exchanger, especially intended for cooling supercharging air in a supercharged internal combustion engine of a motor vehicle.

The invention relates more particularly to a heat exchanger, especially of the air-to-air type, for a supercharged internal combustion engine, of the type provided with at least one first manifold and one second manifold, which are connected transversely by a bundle of horizontal tubes, in which there circulates an internal air flow to be cooled by a flow of cooling fluid circulating outside the tube bundle.

II. Description of Related Art

In supercharged internal combustion engines, it is known that cooling devices or "intercoolers", such as a thermal or heat exchanger, can be used to cool the supercharging air in order to reduce the heat load on the engine, the temperature of the exhaust gases and consequently the NOx emissions and the fuel consumption.

The supercharging air can be cooled primarily in two ways, either by the cooling fluid of the engine or by the outside ambient air.

In the case of cooling by water, the position at which the intercooler is mounted—typically an exchanger of the air-to-water type—can be chosen freely, which is highly advantageous in view of the extreme compactness of water-cooled intercoolers. Nevertheless, it is not possible to lower the temperature of the supercharging air to the desired value, which is generally below that of the cooling fluid.

This is the reason for which motor vehicles provided with supercharged or turbocompressed internal combustion engines are almost exclusively equipped with air-cooled intercoolers for the supercharging air, generally in the form of at least one heat exchanger of the air-to-air type.

U.S. Pat. No. 4,702,079 describes an example of a heat exchanger of the air-to-air type which, as can be seen in particular from FIG. 2 of that document, is most often mounted at the front of the vehicle in such a way that it is ventilated by the dynamic pressure of the outside air when the vehicle is in motion.

Of course, the air-to-air exchanger can also be placed in a different location of the engine compartment of the vehicle, but then it must be ventilated by means of a separate blower, such as a motorized fan assembly. Because of costs, weight and space requirements, therefore, such a solution is rarely employed.

In the case of installation of the exchanger at the front of the vehicle, it is also necessary to take other constraints into consideration, more particularly constraints relating to safety, such as respect for standards relating to a collision with a pedestrian.

Thus the air-to-air exchanger is generally placed in front of the water radiator, with the advantage of always having sufficient cooling at low speed by virtue of the presence of the fan of the water radiator.

On the other hand, however, such an installation runs the risk of obstructing the circulation and arrival of outside cooling air and the drawback of "preheating" the cooling air, with the consequence that the water radiator has to be overdimensioned.

In order to remedy these disadvantages, solutions are being sought that permit the exchangers (or intercoolers) for the supercharging air to be installed above or below the water radiator.

Nevertheless, such an installation necessitates using, especially for reasons of space requirement, a heat exchanger having appropriate length, width and height dimensions, meaning an exchanger in the overall shape of a "bar", wherein the tube bundle has great length compared with its respective width and height.

In a heat exchanger, the head loss for a given number of tubes increases with the length of the bundle tubes through which the supercharging air flow is passing.

In addition, the bundle tubes are generally provided with means such as "turbulators", so named because they bring about turbulent or non-laminar flow of the air to be cooled, for the purpose of increasing the heat exchanges between the air to be cooled and the cooling fluid.

Therefore, the scope of head losses in such exchangers heretofore has compromised their use in applications for cooling the supercharging air of an internal combustion engine.

BRIEF SUMMARY OF THE INVENTION

To remedy these disadvantages, the invention proposes a heat exchanger, especially of the air-to-air type, wherein the internal head loss is particularly reduced.

With this goal, the invention proposes a heat exchanger of the type described hereinabove, characterized in that the tube bundle is provided with at least:

- a first part provided with a first series of tubes with turbulators having a total passage section and a second series of tubes without turbulators having a total passage section globally equivalent to the total passage section,
- a second part provided with a first series of tubes without turbulators having a total passage section and a second series of tubes with turbulators having a total passage section globally equivalent to the total passage section,
- and a box for distribution of the internal flow of air to be cooled, provided with means for connecting the outlet of the first series of tubes with turbulators of the first part to the inlet of the first series of tubes without turbulators of the second part, and for connecting the outlet of the second series of tubes without turbulators of the first part to the inlet of the second series of tubes with turbulators of the second part.

Advantageously, the heat exchanger according to the invention exhibits a smaller space requirement while having cooling capacity and head loss equivalent to those of prior art heat exchangers, permitting it in particular to be installed below the water radiator of the engine.

According to other characteristics of the invention:

- the first series of tubes with turbulators of the first part is provided with an upper group of tubes and a lower group of tubes, and in that the second series of tubes without turbulators of the first part is mounted vertically between the upper and lower groups of tubes of the first series of tubes with turbulators of the first part;
- the first series of tubes without turbulators of the second part is provided with an upper group of tubes and a lower group of tubes, and in that the second series of tubes with turbulators of the second part is mounted vertically between the upper and lower groups of tubes of the first series of tubes without turbulators of the second part;
- the heat exchanger has at least one passage for circulation of the flow (Fe) of cooling fluid between at least one part of the tubes of the first and second series with turbulators and/or of the first and second series without turbulators;

the tubes of the first series and of the second series of each of the parts exhibit, in a vertical section plane, a parallelepiped and especially rectangular longitudinal section;

the first manifold and the second manifold respectively comprise an inlet air box and an outlet air box for the internal air flow to be cooled;

the cooling fluid of the internal air flow consists of an external air flow, such as an air flow resulting from the dynamic air pressure caused by the motion of the vehicle and/or by a motorized fan assembly;

in transverse view the exchanger has generally oblong shape, so that it can be installed in particular above or below the cooling radiator of the engine;

the exchanger has globally parallelepiped/rectangular shape.

BRIEF DESCRIPTION OF THE DRAWINGS

Other characteristics and advantages of the invention will become apparent upon reading the detailed description hereinafter, which description will be understood by referring to the attached figures, wherein.

DETAILED DESCRIPTION OF THE INVENTION

By convention, the terms "first" or "second," "lower" or "upper" and the directions "longitudinal", "transverse" or "vertical" will be used in non-limitative manner in the description and claims to designate respectively the elements or the positions according to the definitions given in the description and according to the three-axis system (L, V, T) represented in the figures.

Figure 1:
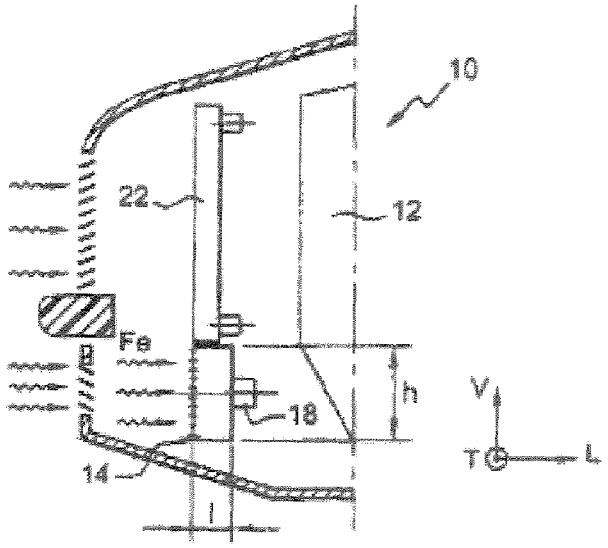
FIG. 1 is a partial side view of the front part of a vehicle in which there is schematically represented the installation of the internal combustion engine, of the cooling radiator and of the heat exchanger according to the teachings of the invention.

FIG. 1 schematically shows the front part of a motor vehicle 10 provided with a motive power unit in the form of internal combustion engine 12, which in this case is of the supercharged type.

In known manner, such a supercharged engine 12 is provided with an intake circuit, an exhaust circuit and a turbocompressor (not shown), which comprises a compressor to compress fresh air from the atmosphere and a turbine to supply the mechanical energy necessary for driving the compressor.

It will be recalled briefly that, during operation of engine 12, the fresh air arriving from the atmosphere is admitted in an inlet part of the intake circuit, after it has passed through the air filter intended to retain the particles present in the fresh air, and that thereafter it is sucked in and compressed by the compressor.

During compression, the air is heated, and so it is necessary that the compressed, fresh, supercharging air then be cooled before arriving in the intake manifold and cyclically supplying the cylinders at a frequency that is a function of the speed of engine 12.

Consequently, the intake circuit is provided with a cooling device, also known as an intercooler, which as explained hereinabove generally consists of a heat exchanger 14 through which there passes a cooling heat-transfer fluid in such a way as to cool the internal supercharging air flow Fi arriving from the compressor.

After combustion, the pressurized exhaust gases are discharged via an exhaust manifold (not shown) into an exhaust pipe (not shown), which selectively feeds the turbine of the turbocompressor before these gases are discharged into the atmosphere.

In the practical example illustrated in the figures, heat exchanger 14 is an exchanger of the air-to-air type, wherein the cooling fluid is an external air flow Fe.

As can be seen in FIG. 1, the external air flow Fe corresponds in particular to the air flow resulting from the dynamic air pressure caused by the motion of the vehicle.

The external air flow Fe is schematically represented here by wavy-shaft arrows, so as to distinguish them from the other arrows in the figures, especially from the straight-shaft arrows schematically representing the internal air flow Fi.

It will be noted that the dimensions of heat exchanger 14, or in other words its width or depth (l), its height (h) and its length (L) correspond in this case to its respective dimensions in the longitudinal, vertical and transverse directions of the three-axis system (L, V, T).

Heat exchanger 14 is provided with a first manifold 16 and a second manifold 18, which are connected transversely by a tube bundle 20, in which there circulates an internal air flow Fi cooled by the cooling external air flow Fe circulating on the outside of tube bundle 20.

Figure 3:
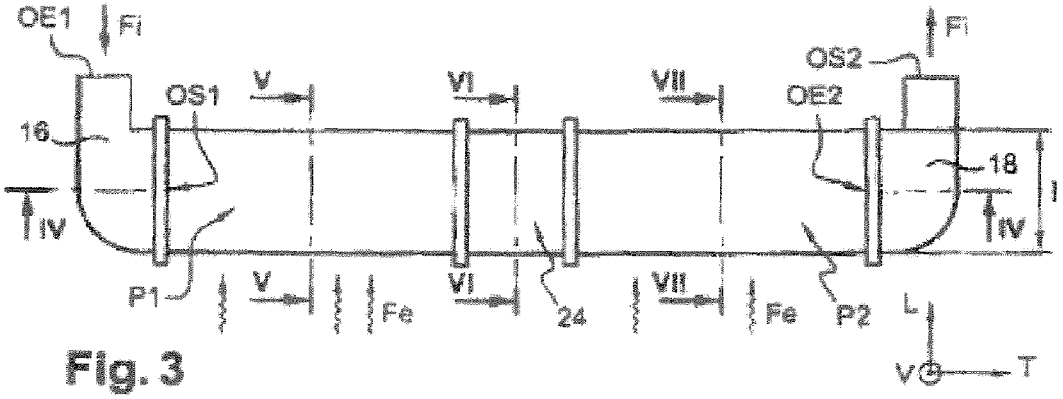
FIG. 3 is a view from above of the heat exchanger according to the invention.

As can be seen in FIG. 3, first manifold 16 and second manifold 18 in this case constitute here an air inlet box and an air outlet box respectively for the internal air flow Fi to be cooled.

Advantageously, the inlet and outlet air boxes are identical, and therefore, in particular, the production cost thereof can be reduced.

Figure 2:
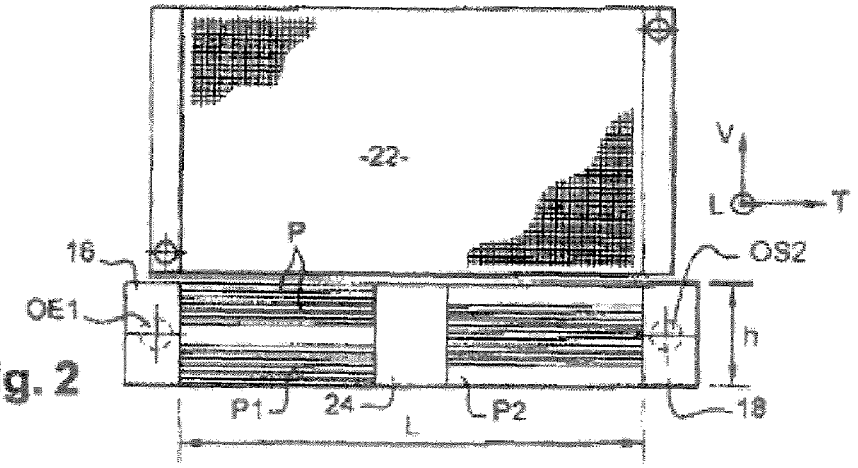
FIG. 2 is a front view of the heat exchanger according to the invention, mounted below the cooling radiator of the engine.

Internal air flow Fi circulates from left to right according to the arrows illustrated in FIGS. 2 and 3, or in other words in transverse direction T).

As illustrated by the arrows in FIGS. 1 and 3, cooling external air flow Fe circulates in longitudinal direction (L), or in other words perpendicular to the transverse direction (T).

Tube bundle 20 comprises mainly a first part P1, a second part P2 and an intermediate distribution box 24 that is interposed transversely, in this case centrally, between first and second parts P1, P2.

Heat exchanger 14 has substantially the shape of a "bar", meaning that in transverse view it has generally oblong shape, in this case globally parallelepiped to rectangular shape. Advantageously, such a heat exchanger 14 is therefore capable of being installed below cooling radiator 22 of the cooling circuit of engine 12, as illustrated in FIGS. 1 and 2.

Alternatively, heat exchanger 14 is installed above cooling radiator 22 of the cooling circuit of engine 12.

Such an installation is now made possible with a heat exchanger 14 designed according to the invention, which makes it possible in particular to reduce the internal head loss compared with prior art exchangers of oblong shape.

Heat exchanger 14 according to the invention is characterized in that tube bundle 20 is provided with at least:

first part P1 comprising a first series S1P1 of tubes equipped with turbulators 34 having a total section or passage area A11 and a second series S2P1 of tubes without turbulators having a total section or passage area A12 globally equivalent to passage section A11, a second part P2 comprising a first series S1P2 of tubes without turbulators having a total section or passage area A21 and a second series S2P2 of tubes equipped with turbulators 34 having a total section or passage area A22 globally equivalent to total passage section A21, and central intermediate box 24 for distribution of the internal air few to be cooled, provided with means for connecting the outlet of first series S1P1 of tubes with turbulators of first part P1 to the inlet of first series S1P2 of tubes without turbulators of second part P2, and for connecting the outlet of second series S2P1 of tubes without turbulators of first part P1 to the inlet of second series S2P2 of tubes with turbulators 34 of second part P2.

Figure 4:
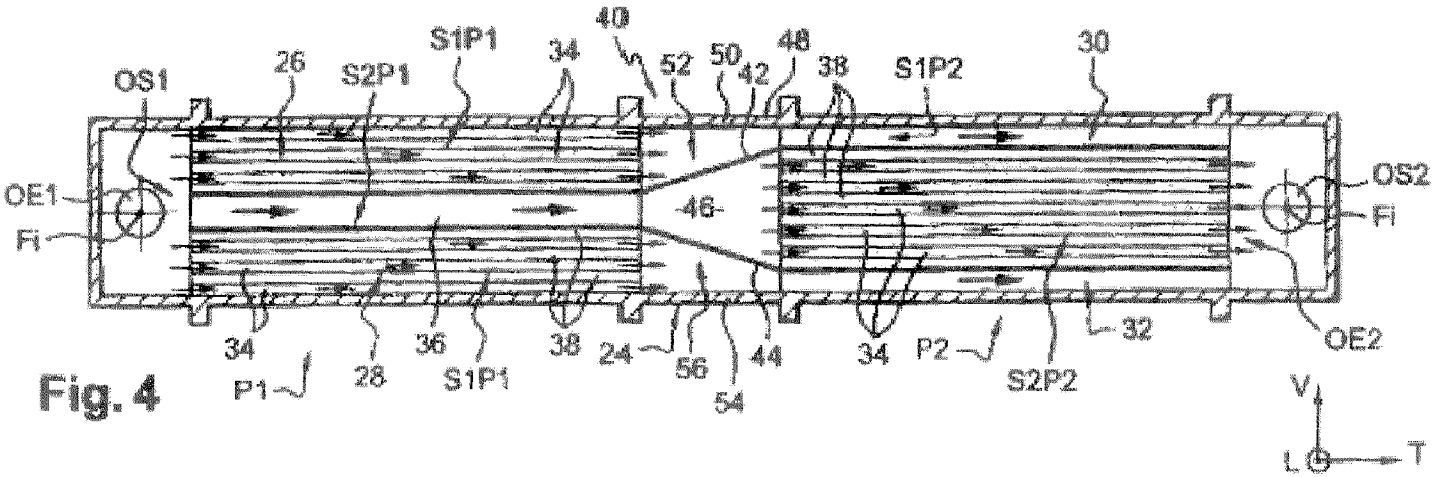
FIG. 4 is a view in transverse and vertical section of the heat exchanger through the corresponding plane IV-IV indicated in FIG. 3, which illustrates a practical example of an exchanger provided with a first and second part respectively equipped with a series of tubes with and without turbulators.

According to the practical example of heat exchanger 14 illustrated in FIG. 4, first series S1P1 of tubes with turbulators 34 of first part P1 of heat exchanger 14 is provided with an upper group 26 of tubes and a lower group 28 of tubes, and second series S2P1 of tubes without turbulators of first part P1 is mounted vertically between upper group 26 and lower group 28 of tubes of first series S1P1 of tubes with turbulators 34 of first part P1.

Similarly, first series S1P2 of tubes without turbulators of second part P2 of heat exchanger 14 is provided with an upper group 30 of tubes and a lower group 32 of tubes, and second series S2P2 of tubes with turbulators 34 of second part P2 is mounted vertically between upper group 30 and lower group 32 of tubes of first series SIP2 of tubes without turbulators of second part P2.

In the practical example illustrated in FIG. 4, second series S2P1 without turbulators of first part P1 comprises a single central tube 36, and first series S1P2 without turbulators of second part P2 comprises an upper tube 30 and a lower tube 32 forming the upper and lower groups respectively in this case.

Figure 7:
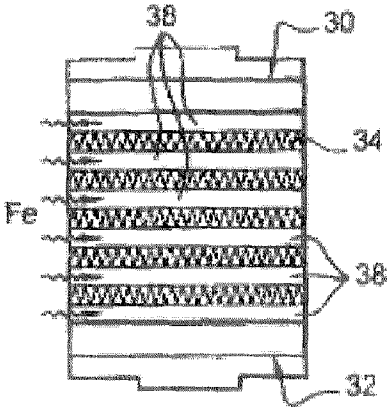
FIGS. 5 to 7 are respectively views in longitudinal and vertical section of the first part, of the distribution box and of the second part through the corresponding vertical planes V-V to VII-VII indicated in FIG. 3.
Figure 5:
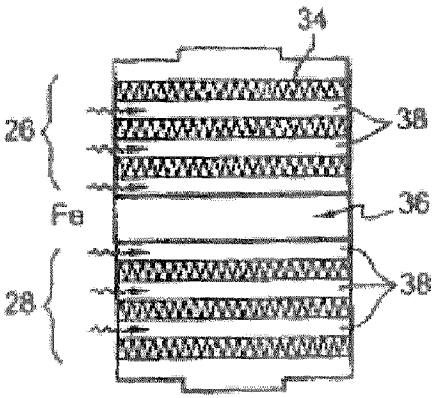

The tubes containing turbulators 34 were represented in FIG. 4 as "gray-shaded" or "cross-hatched" in order to differentiate them, and otherwise are more readily visible in the sections of FIGS. 5 and 7.

Heat exchanger 14 is provided with circulation passages 38 for the external cooling air flow Fe, preferably between each of the tubes of first series S1P1 and of second series S2P1, in order to optimize the heat exchanges between internal flow Fi and external air flow Fe.

Passages 38 are visible in particular in the front view of FIG. 2 and in the sectional view of FIG. 4.

Intermediate distribution box 24 is provided with means 40 for connecting the outlet of first series S1P1 of tubes equipped with turbulators 34 of first part P1 to the inlet of first series S1P2 of tubes without turbulators of second part P2, and for connecting the outlet of second series S2P1 of tubes without turbulators of first part P1 to the inlet of second series S2P2 of tubes equipped with turbulators 34 of second part P2.

Means 40 for connecting distribution box 24 are composed of an inclined upper transverse plate 42 and an inclined lower transverse plate 44, which vertically bound between them an internal diverging segment 46 for connection between the outlet of central tube 36 without turbulators of first part P1 and the inlets of each of the tubes of second series S2P2 of tubes containing turbulators 34.

Upper plate 42, together with upper horizontal wall 48 of body 50 of box 24, vertically bounds an upper converging segment 56 for connection between the outlets of each tube of upper group 26 of first series S1P1 of tubes containing turbulators 34 and the inlet of upper tube 30.

Lower plate 44, together with lower horizontal wall 54 of body 50 of box 24, vertically bounds a lower converging segment 52 for connection between the outlets of each tube of lower group 28 of first series S1P1 of tubes containing turbulators 34 and the inlet of lower tube 32.

Figure 6:
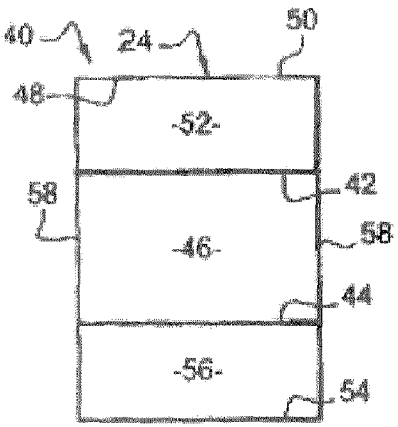

As illustrated in FIG. 6, connecting segments 46, 52 and 56 are also bounded longitudinally by opposite transverse walls 58 of body 50 of box 24.

Hereinafter there will be described the operation of heat exchanger 14 according to the invention and the cooling of internal air flow Fi by external air flow Fe.

First manifold 16 forming the inlet air box is provided with an inlet orifice OE1, which is connected to an upstream element of the intake pipe of the intake circuit of engine 12, and with an outlet orifice OS1, which discharges into bundle 20.

Thus internal air flow Fi to be cooled and arriving from the compressor enters first manifold 16 via inlet orifice OE1 from which it exits via orifice OS1, in order firstly to pass through first part P1 of heat exchanger 14.

Internal air flow Fi becomes distributed so as to circulate respectively in first series S1P1 of tubes with turbulators having total passage section A11 and in second series S2P1 of tubes without turbulators having total passage section A12.

Global passage section A1 of first part P1 corresponds globally to the sum of total passage sections A11 and A12 respectively of first series S1P1 and of second series S2P1, in such a way that internal air flow Fi is divided into to parts Fi1 and Fi2 and in this case becomes distributed equally between first series S1P1 and second series S2P1.

Part Fi1 of internal air flow Fi is cooled during its passage through first series S1P1 of tubes, whose turbulators 34 permit enhanced dissipation of heat by external cooling air flow Fe circulating in passages 38.

The other part Fi2 of internal air flow Fi passing through second series S2P1 of tubes without turbulators is cooled only slightly, but on the other hand suffers only little or no head losses.

Thus, during its passage through first part P1, internal air flow Fi suffers a first head loss caused mainly by first series S1P1 of turbulated tubes.

After it has passed through first part P1, internal air flow Fi to be cooled, corresponding respectively to parts Fi1 and Fi2, then passes through distribution box 24, before passing through second part P2 of heat exchanger 14.

Thus part Fi1 of internal air flow Fi that has passed through first series S1P1 of tubes with turbulators of first part P1 to be cooled therein therefore subsequently passes through first series S1P2 of tubes without turbulators in second part P2, suffering little or no head losses.

Conversely, the other part Fi2 of internal air flow Fi that has passed through second series S2P1 of tubes without turbulators of first part P1 with little or no head losses subsequently passes through second series S2P2 of tubes with turbulators 34 of second part P2, in order to be cooled in turn therein.

Advantageously, second part P2 of heat exchanger 14, just as first part P1, is provided with passages 38 for circulation of external cooling air flow Fe between each of the tubes of first series S1P2 and of second series S2P2, in order to optimize the heat exchanges between internal flow Fi and external air flow Fe.

Internal air flow Fi emerging from the respective outlets of first and second series S1P2 and S2P2 of tubes discharges into at least one inlet orifice OE2 of second manifold 18, forming the outlet air box, then continues its course in a downstream element of the pipe of the intake circuit of engine 12, to which there is connected at least one outlet orifice OS2 of second manifold 18.

Preferably, in first and second parts P1, P2, first series S1P1 and S1P2 of tubes have total passage sections A11 and A21 that respectively are globally equivalent to total passage sections A12 and A22 of first and second series S2P1 and S2P2 of tubes.

As illustrated in FIGS. 5 to 7, the tubes of first series S1P1 and S1P2 as well as the tubes of second series S2P1 and S2P2 of each of first and second parts P1, P2 exhibit, in a vertical section plane, a parallelepiped and in this case rectangular longitudinal section.

Alternatively (not illustrated), the tubes of first series S1P1 and S1P2 as well as the tubes of second series S2P1 and S2P2 of each of first and second parts P1, P2 exhibit, in a vertical section plane, a globally circular longitudinal section.

By virtue of the invention, it is possible to construct a heat exchanger 14 of oblong shape, or in other words of great length (L) and small height (h), which thus is capable of being installed below or above radiator 22.

The dimensions of bundle 20 of heat exchanger 14 range, for example, between 500 and 800 mm for the length (L), between 40 and 200 mm for the height (h) and between 50 and 120 mm for the width (1).

By comparison with a prior art heat exchanger provided with a bundle of horizontal tubes of length "L", each part of flow Fi passing through a series of tubes equipped with turbulators 34 actually travels only one half of this length between inlet orifice OE1 and outlet orifice OE2, or in other words "L/2", whether in first part P1 or in second part P2, thus making it possible to achieve a reduction of the head loss.

In addition, by comparison with a prior art heat exchanger, the number of horizontal tubes of the bundle is advantageously increased.

Advantageously, such an arrangement of a heat exchanger 14 makes it possible to suppress problems such as the "mask effect" caused if a first exchanger is mounted in front of a second exchanger such as the cooling radiator, thus constituting a "screen" for the second exchanger and in particular tending to interfere with the circulation of the external cooling air flow.

In addition, such an installation of heat exchanger 14 facilitates connecting the inlet and outlet orifices of the exchanger to the respective pipes of the intake circuit, improving in particular the accessibility to exchanger 14 and in addition making it possible to simplify the paths of the pipes, which heretofore have been tortuous and of greater length.

Of course, the notions of "inlet" and "outlet" are relative, and consequently they are not limitative as regards possible alternative embodiments, especially as a function of the applications.

Thus, without going beyond the scope of the invention, internal air flow Fi can in particular circulate in bundle 20 of tubes in inverse direction, meaning from right to left, first passing through second part P2 then distribution box 24 and finally first part P1.

In this case, second manifold 18 constitutes an inlet air box for internal air flow Fi, and first manifold 16 constitutes an outlet air box.

Advantageously, a motorized fan assembly, such as a motorized fan assembly associated with the radiator of the engine-cooling circuit, is capable of supplying heat exchanger 14 adequately with cooling air when the external air flow created by the motion of the vehicle is insufficient particularly when the vehicle is coasting gently or is stopped, even though engine 12 is still running.

Of course, the invention is applicable to all types of heat exchangers, and the heat exchanger of air-to-air type illustrated by the figures is given merely by way of non-limitative example; furthermore, as an alternative, the tubes of bundle 20 can be vertical.

Alternatively, heat exchanger 14 is of the air-to-liquid type, in which the cooling liquid can be, for example, water or oil.

The invention claimed is:

1. A heat exchanger for a supercharged internal combustion engine, comprising:

at least one first manifold and one second manifold, which are connected in a transverse direction by a bundle of horizontal tubes that extend in said transverse direction and are positioned entirely between the first manifold and the second manifold, and an internal air flow circulates in the tube bundle to be cooled by a flow of cooling fluid circulating outside the tube bundle;

wherein the tube bundle includes:

a first part including a first series of tubes with turbulators having a first total passage section and a second series of tubes without turbulators having a second total passage section globally equivalent to the first total passage section, a second part including a first series of tubes without turbulators having a third total passage section and a second series of tubes with turbulators having a fourth total passage section globally equivalent to the third total passage section, and a box configured to distribute the internal flow of air to be cooled, including means for connecting an outlet of the first series of tubes with turbulators of the first part to an inlet of the first series of tubes without turbulators of the second part, and for connecting an outlet of the second series of tubes without turbulators of the first part to an inlet of the second series of tubes with turbulators of the second part, wherein the first series of tubes of the first part is entirely upstream in the transverse direction from the first series of tubes of the second part, and wherein the second series of tubes of the first part is entirely upstream in the transverse direction from the second series of tubes of the second part.

2. A heat exchanger according to claim 1, further comprising at least one passage for circulation of flow of cooling fluid between at least one part of the tubes of the first and second series with turbulators and/or of the first and second series without turbulators.

3. A heat exchanger according to claim 1, wherein the tubes of the first series and of the second series of each of the parts exhibit, in a vertical section plane, a parallelepiped or rectangular longitudinal section.

4. A heat exchanger according to claim 1, wherein the first manifold and the second manifold respectively comprise an inlet air box and an outlet air box for the internal air flow to be cooled.

5. A heat exchanger according to claim 1, wherein the cooling fluid of the internal air flow includes an external air flow, or an air flow resulting from dynamic air pressure caused by motion of a vehicle and/or by a motorized fan assembly.

6. A heat exchanger according to claim 1, wherein, in transverse view, the heat exchanger has a generally oblong shape, so to be installed above or below a cooling radiator of the engine.

7. A heat exchanger according to claim 6, wherein the heat exchanger has a globally parallelepiped/rectangular shape.

8. A heat exchanger according to claim 1, wherein the means for connecting includes at least one plate to prevent any of the internal air flow in the first series of tubes with turbulators of the first part from entering the inlet of the second series of tubes with turbulators of the second part.

9. A heat exchanger according to claim 1, wherein the means for connecting includes at least one plate to prevent any of the internal air flow in the second series of tubes without turbulators of the first part from entering the inlet of the first series of tubes without turbulators of the second part.

10. A heat exchanger according to claim 1, wherein the first series of tubes from the first part is connected via the box to the first series of tubes from the second part such that all of the internal air flow in the first series of tubes from the first part enters the first series of tubes from the second part.

11. A heat exchanger according to claim 1, wherein the second series of tubes from the first part is connected via the box to the second series of tubes from the second part such that all of the internal air flow in the second series of tubes from the first part enters the second series of tubes from the second part.

12. A heat exchanger for a supercharged internal combustion engine, comprising:

at least one first manifold and one second manifold, which are connected by a bundle of horizontal tubes, in which there circulates an internal air flow to be cooled by a flow of cooling fluid circulating outside the tube bundle;

wherein the tube bundle includes:

a first part including a first series of tubes with turbulators having a first total passage section and a second series of tubes without turbulators having a second total passage section globally equivalent to the first total passage section, a second part including a first series of tubes without turbulators having a third total passage section and a second series of tubes with turbulators having a fourth total passage section globally equivalent to the third total passage section, a box configured to distribute the internal flow of air to be cooled, including means for connecting an outlet of the first series of tubes with turbulators of the first part to an inlet of the first series of tubes without turbulators of the second part, and for connecting an outlet of the second series of tubes without turbulators of the first part to an inlet of the second series of tubes with turbulators of the second part, and the first series of tubes with turbulators of the first part includes an upper group of tubes and a lower group of tubes, and the second series of tubes without turbulators of the first part is mounted vertically between the upper and lower groups of tubes of the first series of tubes with turbulators of the first part.

13. A heat exchanger according to claim 12, wherein the means for connecting includes at least one plate to prevent any of the internal air flow in the first series of tubes with turbulators of the first part from entering the inlet of the second series of tubes with turbulators of the second part.

14. A heat exchanger according to claim 12, wherein the means for connecting includes at least one plate to prevent any of the internal air flow in the second series of tubes without turbulators of the first part from entering the inlet of the first series of tubes without turbulators of the second part.

15. A heat exchanger for a supercharged internal combustion engine, comprising:

at least one first manifold and one second manifold, which are connected by a bundle of horizontal tubes, in which there circulates an internal air flow to be cooled by a flow of cooling fluid circulating outside the tube bundle;

wherein the tube bundle includes:

a first part including a first series of tubes with turbulators having a first total passage section and a second series of tubes without turbulators having a second total passage section globally equivalent to the first total passage section, a second part including a first series of tubes without turbulators having a third total passage section and a second series of tubes with turbulators having a fourth total passage section globally equivalent to the third total passage section, a box configured to distribute the internal flow of air to be cooled, including means for connecting an outlet of the first series of tubes with turbulators of the first part to an inlet of the first series of tubes without turbulators of the second part, and for connecting an outlet of the second series of tubes without turbulators of the first part to an inlet of the second series of tubes with turbulators of the second part, and the first series of tubes without turbulators of the second part includes an upper group of tubes and a lower group of tubes, and the second series of tubes with turbulators of the second part is mounted vertically between the upper and lower groups of tubes of the first series of tubes without turbulators of the second part.

16. A heat exchanger according to claim 15, wherein the means for connecting includes at least one plate to prevent any of the internal air flow in the first series of tubes with turbulators of the first part from entering the inlet of the second series of tubes with turbulators of the second part.

17. A heat exchanger according to claim 15, wherein the means for connecting includes at least one plate to prevent any of the internal air flow in the second series of tubes without turbulators of the first part from entering the inlet of the first series of tubes without turbulators of the second part.

* * * * *